United States Patent [19]

Mori et al.

[11] Patent Number: 4,603,065

[45] Date of Patent: Jul. 29, 1986

[54] DECORATIVE PART

[75] Inventors: Takaaki Mori, Handa; Toshiyasu Ito, Kasugai; Tetsuya Fujii, Nishikasugai, all of Japan

[73] Assignee: Toyoda Gosei Co., Ltd., Nishikasugai, Japan

[21] Appl. No.: 697,939

[22] Filed: Feb. 4, 1985

[30] Foreign Application Priority Data

Feb. 10, 1984 [JP] Japan ..... 59-024101

[51] Int. Cl.[4] ..... G09F 13/22

[52] U.S. Cl. ..... 428/31; 40/544; 428/195; 428/690; 428/698; 428/917

[58] Field of Search ..... 428/917, 31, 195, 690, 428/698; 40/544

[56] References Cited

U.S. PATENT DOCUMENTS 3,436,242 4/1969 Schaffner ..... 428/917 X
3,456,043 7/1969 Emery ..... 428/917 X
4,376,145 3/1983 Frame ..... 428/917 X

FOREIGN PATENT DOCUMENTS 4330119 6/1965 Japan ..... 428/917 X
2099628 12/1982 United Kingdom ..... 40/544

*Primary Examiner*—Henry F. Epstein
*Attorney, Agent, or Firm*—Cushman, Darby & Cushman

[57] ABSTRACT

The decorative part of this invention, which means a part having an aesthetically treated indication, comprises a first indicator which permits the transmission of light, a semitransparent part placed behind the first indicator which reflects the light coming from the front and passes the light coming from the rear, a second indicator which permits the partial transmission of light and is placed behind the semitransparent part, and an illuminant placed behind the second indicator. Thus, it is possible to switch the display of the decorative part as desired by turning on and off the illuminant at proper time.

3 Claims, 4 Drawing Figures

DECORATIVE PART

BACKGROUND OF THE INVENTION

1. Field of the Invention

The present invention relates to a decorative part suitable for an emblem, top mark, decorative molding, or nameplate of a car. More particularly, the invention relates to a decorative part which is improved such that the characters or patterns on an emblem or top mark can be changed as required. An emblem is an object that shows the name of manufacturer, the name of car, the class of car, etc. in a symbolized sign. A top mark is an object bearing the above-mentioned sign which is mounted on the front part of the hood. A molding is a long narrow member used for external decoration of a car. A nameplate is an object which indicates the name of manufacturer in letters. A garnish is a decorative part which covers a certain part or edge of the interior of a car.

2. Description of the Prior Art

The typical decorative parts used in cars include emblems, top marks, moldings, and nameplates. The main constituent in these decorative parts is the indicator showing characters, patterns, and/or symbols in certain thickness. In the case of conventional decorative parts, it is impossible to change what the indicator shows whenever required.

SUMMARY OF THE INVENTION

The present invention was completed with the above-mentioned technical background in mind. Accordingly, it is an object of this invention to provide an improved decorative part having a plurality of indicators which can be switched from one to another whenever required, for example, in daytime and at night.

The decorative part of this invention comprises a first indicator which permits the transmission of light, a semitransparent part placed behind said first indicator which reflects the light coming from the front and passes the light coming from the rear, a second indicator which permits the partial transmission of light and is placed behind said semitransparent part, and an illuminant placed behind said second indicator. The term "front" means that side of the decorative part which faces a person who watches the decorative part, and the term "rear" means that side of the decorative part which is farthest from a person who watches the decorative part.

The decorative part of this invention means a part having an aesthetically treated indicator. Examples of such decorative parts include emblems, top marks, moldings, nameplates, garnishes, and number plates which are used for vehicles, particularly automobiles. However, the usage of the decorative part of this invention is not limited to them; it will be suitably used for decorating the exterior and interior of a car.

The first indicator, which is one of the constituents of the invention, is an object which shows a specific sign. Usually, it is made of coated film or deposited film that forms aesthetically designed characters, patterns or symbols.

In the case where the decorative part of this invention is used as an emblem, the pattern formed on the surface of the emblem is the first indicator. In the case where it is used as a nameplate, what constitutes the characters of the name is the first indicator. The first indicator is placed at that side of the decorative part which faces a person who watches the decorative part. Incidentally, the first indicator is given a proper color according to the application of the decorative part.

The first indicator is required to have a property that permits the transmittance of light. Therefore, it should be made of a colored semitransparent film. For example, it should preferably be made up of a transparent substrate and a colored translucent film formed on the surface thereof. The thickness of the translucent film should preferably be 10 to 100 micrometers. This translucent film may be formed by screen printing or spray coating on the surface of a transparent substrate. Usually, the ink or paint for printing or coating is of translucent type. The translucent film may also be formed by sputtering, vacuum deposition, or ion plating of metal or ceramics on the surface of a transparent substrate.

The transparent substrate may be in any form, e.q., thin plate, thick plate, film, or concave or convex lens. The substrate should preferably be as transparent as possible. Thus the substrate should preferably be made of transparent glass or plastics. The substrate should preferably be colorless and transparent; but it may be colored and transparent. A transparent substrate may be made of polyvinyl chloride resin, ABS resin, polycarbonate resin, or acrylic resin.

The semitransparent part, which is one of the constituents of the invention, reflects the light coming from the front and passes the light coming from the rear. The light coming from the front means the light which is emitted from the front side or the side of the person who watches the decorative part. The light coming from the rear means the light which is emitted from the opposite side of the person who watches the decorative part or the light which is emitted by the illuminant. The light means visible light. The reflectance for the light coming from the front and the transmittance for the light coming from the rear should be as high as possible. The semitransparent part may be formed by any known means such as thin film technology. For example, it may be formed by sputtering or vacuum deposition on the back of said substrate. The thin film thus formed increases the transmittance of the light coming from the rear and the reflectance of the light coming from the front. The thin film may be made of TiO, CeO, Al, Ag, Cr, or Au. The thickness of the thin film should preferably be 100 to 1000 A. The thin film may be a single layer or multiple layers. In the latter case, a titanium oxide film or the like having a high refractive index and a silicon dioxide film or the like having a low refractive index are laminated on top of the other. The multilayered thin film is more effective in the prevention of the reflection of the light coming from the rear and the increase of the reflection of the light coming fromthe front. A known half-mirror may also be used as the semitransparent part.

The second indicator, which is one of the constituents of the invention, is intended to show a specific sign in the same way as the first indicator. Usually, it bears aesthetically designed characters, or symbols. In the case where the decorative part of this invention is used as an emblem, the pattern of the emblem is drawn on the second indicator. In the case where it is used as a nameplate, the characters of the name are written on the second indicator.

The second indicator is required to be at least partially transparent. Those sections which pass the light perform display. The second indicator may be formed by opening windows on a light-shielding material. In this case, the windows not covered by the light-shielding material permits the transmission of light, whereby performing a desired display. The second indicator may be formed by screen printing a lightshielding ink or paint on a transparent or translucent film or plate, whereby forming a light-shielding film and simultaneously forming windows. The light-shielding film should preferably be 70 micrometers. The lightshielding film of the second indicator may be formed by plating, vacuum deposition, sputtering, or ion plating. Those sections where the light-shielding film is not formed become the above-mentioned windows.

The illuminant, which is one of the constituents of the invention, is placed behind the second indicator. The illuminant may be of any type so long as it is capable of emitting light toward the semitransparent part. Thus any known illuminant may be used. An illuminant having a luminance of 1 to 1000 foot Lambert is desirable. A typical illuminant that can be used is an electroluminescent panel which emits light upon application of electrical field to a fluorescent substance. The electroluminescent panel (EL panel) is formed by attaching electrodes to both sides of a lightemitting layer of zinc sulfide (ZnS) or zinc selenide (ZnSe) in the form of panel. When a voltage is applied across the electrodes, the light-emitting layer emits light. The luminance of the EL panel formed as mentioned above is not so high for illumination; but it is sufficient for a person to recognize characters from a distance at night. The EL panel has many advantages. It has a luminance of 1 to 100 foot Lambert. It can be recognized easily. It emits light in many different colors. It is a surface illuminant. The voltage to be applied to an EL panel is 50 to 150 volts. This voltage can be supplied by using a booster (which raises the battery voltage—12 V) in the case where an EL panel is used on a car. The El panel in this invention may be distributed type, thin film type, glass type, enamel type, or flexible type. The color of the EL panel may be selected from green, blue, red, yellow, white, white yellow, or yellow orange. In the meantime, the EL panel is vulnerable to moisture, and therefore, it should be provided with a moistureproofing means, such as moistureproof coating or embedding in a transparent plastic, in the case where it is used for a decorative part such as an emblem of a car. The illuminant is not necessarily limited to an EL panel; a light-emitting diode or fluorescent lamp may be used according to the type of the decorative part.

The above-mentioned first indicator, second indicator, semitransparent part, and illuminant may be accomodated in a container or frame when in use.

We have described the structure of the decorative part of this invention. Now we describe in the following the typical usage of the decorative part of this invention.

In an instance where it is desirable to let the first indicator work in daytime or at a bright place, the illuminant is turned off so that the light from the illuminant does not enter the semitransparent part. In such an instance, the first indicator is visible to a person watching the front of the decorative part, but the second indicator is completely invisible or hardly visible, because the illuminant is turned off and the light coming from the front is mostly reflected by the semitransparent part.

In another instance where it is desirable to let the second indicator work at night or at a dark place, the illuminant is caused to emit light by applying an electric current. The light from the illuminant passes through the windows on the second indicator, the semitransparent part, and the first indicator and reaches the person in front of the decorative part. In other words, the second indicator is visible to the person in front of the decorative part; but the first indicator is completely invisible or hardly visible because it is transparent.

As mentioned above, the first indicator is visible when the illuminant is turned off in daytime or at a bright place, and the second indicator is visible when the illuminant is turned on at night or at a dark place. Thus it is possible to switch the display of the decorative part as desired by turning on and off the illuminant at a proper time. In other words, the decorative part of this invention displays the first indicator when the illuminant is turned off in daytime or at a bright place, and displays the second indicator when the illuminant is turned on at night or at a dark place.

BRIEF DESCRIPTION OF THE DRAWINGS

Other objects and features of the invention will become apparent to those skilled in the art as the disclosure is made in the following description of a preferred embodiment of the invention, as illustrated in the accompanying sheet of drawings, in which.

DESCRIPTION OF THE PREFERRED EMBODIMENT

Figure 1:
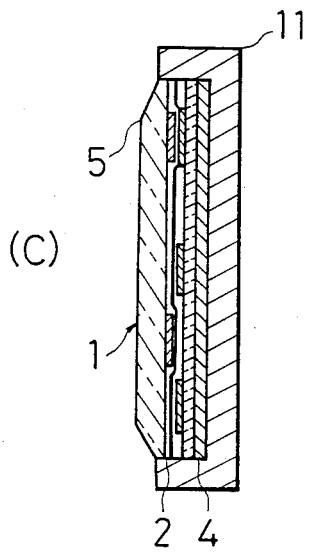
FIG. 1 is a longitudinal sectional view of the decorative part of this invention.
Figure 2:
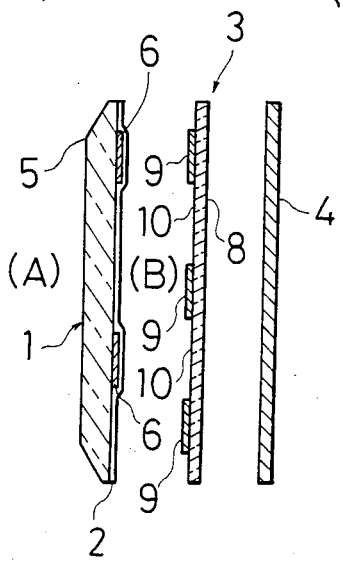
FIG. 2 is a longitudinal sectional view, with the important parts disassembled.

FIGS. 1 to 4 illustrate an embodiment of the decorative part of this invention. FIG. 1 is a longitudinal sectional view. FIG. 2 is a longitudinal sectional view, with the important parts disassembled. The illustrated decorative part is designed for use on the hood. The decorative part in this example is made up of a first indicator 1, a semitransparent part 2 placed behind the first indicator 1, a second indicator 3 placed behind the semitransparent part 2, and an illuminant (EL panel) 4 placed behind the second indicator 3.

Figure 3:
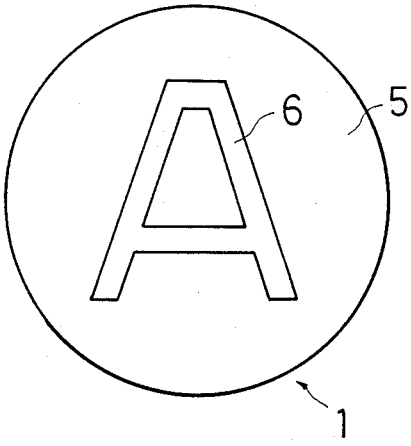
FIG. 3 is a front view of the first indicator.

The first indicator 1 bears the character A as shown in FIG. 3. The character A is formed by applying a yellow acrylic paint to the back of a transparent substrate 5 made of clear acrylic resin, as shown in FIG. 2. The yellow acrylic paint forms a translucent film 6. The thickness of the substrate 5 is 2 to 4 mm and the thickness of the translucent film 6 is about 50 micrometers.

The semitransparent part 2 is formed by aluminum sputtering on the back of the substrate 5. The thickness of the sputtering film is 200 A. The semitransparent part 2 passes the light in the direction from (B) to (A) in FIG. 2 but reflects most of the light in the direction from (A) to (B) in FIG. 2. This semitransparent part 2 conceals the light-shielding part 9 in daytime.

The EL panel 4 is composed of a transparent electrode layer made of ITO (indium-tin oxide), a lightemitting layer of zinc sulfide, an aluminum electrode layer, and lead wires connected to the electrodes. This EL panel is of organic dispersion type, having a thickness of 0.8 mm. It emits green light when activated with 60 volts, 400 Hz. The luminance is about 12 foot Lambert.

Figure 4:
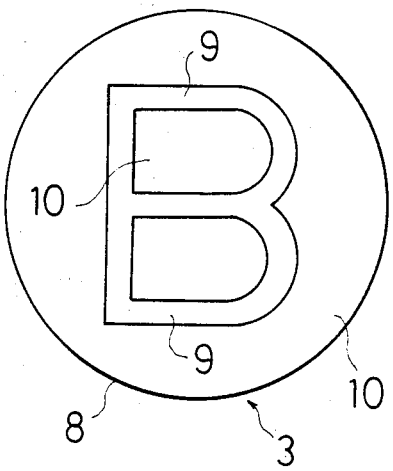
FIG. 4 is a front view of the second indicator.

The second indicator in this example bears the character B as shown in FIG. 4. The character is formed on a 200-micron thick transparent polyester film 8 with a light-shielding part 9, with windows 10 left uncoated. In this example, the light-shielding part 9 is formed by applying a black acrylic paint in a thickness of about 70 micrometers by screen printing.

The above-mentioned first indicator 1, semitransparent part 2, second indicator 3, and EL panel 4 are accommodated in a frame 11 made of ABS resin.

If the EL panel 4 is turned off in daytime, the character A on the first indicator is visible to a person in front of the decorative part or at the side (C) in FIG. 1. This is because the side (C) is bright in daytime. The character B on the second indicator is completely invisible or hardly visible. This is because the bright light entering from the side (C) is reflected for the most part by the semitransparent part 2 and the EL panel 4 which is turned off looks dark.

The EL panel 4 is turned on at night so that emits green light. The light emitted from the EL panel is partly intercepted by the light-shielding part 9; but the other part of the light passes through the windows 10, the semitransparent part 2, and the transparent substrate 5. As the result, the second indicator 3 is visible in green color to a person in front of the decorative part. In this instance, the character A is hardly visible because it is made of the translucent film 6 and the surrounding of the decorative part is dark at night.

The above-mentioned example which employs the EL panel 4 as an illuminant has the following advantages. The second indicator is highly visible at night or in a dark place.

The EL panel, which is a surface illuminant, makes it possible to display a large area. The EL panel consumes only a small amount of electric energy. The EL panel is thin, say 0.8 mm, and this makes it possible to produce a thin decorative part. The EL panel is superior in shock resistance. For these advantages, the decorative part of this invention is suitable for emblems, top marks, etc. of a car.

What is claimed is:

1. A display device having a front and back comprising:

a front part comprising a front transparent substrate, a first pattern of translucent material covering portions of the back of said substrate and a semitransparent film covering said pattern and those portions of the back of said substrate not covered by said pattern, said film reflecting light coming from the front and passing light coming from the back;

an intermediate part comprising a transparent layer and a second pattern of opaque material covering portions of said layer; and a back part comprising an off-on illuminant, whereby said first pattern is visible in relatively bright light when said illuminant is off and said second pattern is visible in relative darkness when said illuminant is on.

2. A display device as set forth in claim 1, wherein the illuminant is an electroluminescent panel.

3. A display device as set forth in claim 1, wherein the translucent film is colored.

* * * * *